US011162495B2

(12) United States Patent
Branch et al.

(10) Patent No.: US 11,162,495 B2
(45) Date of Patent: Nov. 2, 2021

(54) OIL CIRCULATION IN A SCROLL COMPRESSOR

(71) Applicant: TRANE INTERNATIONAL INC., Davidson, NC (US)

(72) Inventors: Scott M. Branch, Tomah, WI (US); Derrick Lepak, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 130 days.

(21) Appl. No.: 15/783,615

(22) Filed: Oct. 13, 2017

(65) Prior Publication Data

US 2019/0113037 A1 Apr. 18, 2019

(51) Int. Cl.

| | |
|---|---|
| ***F04C 29/02*** | (2006.01) |
| ***F04C 29/00*** | (2006.01) |
| ***F04C 18/02*** | (2006.01) |
| ***F04C 23/00*** | (2006.01) |

(52) U.S. Cl.

CPC ..... *F04C 29/02* (2013.01); *F04C 18/0215* (2013.01); *F04C 23/008* (2013.01); *F04C 29/0085* (2013.01); *F04C 29/028* (2013.01); *F04C 2240/40* (2013.01); *F04C 2240/50* (2013.01)

(58) Field of Classification Search

CPC .... F04C 29/02; F04C 29/023; F04C 18/0215; F04C 29/028; F04C 29/021; F04C 23/008; F04C 15/0092

See application file for complete search history.

(56) References Cited

U.S. PATENT DOCUMENTS

| | | | | |
|---|---|---|---|---|
| 4,621,993 | A * | 11/1986 | Nakamura | F04C 29/028 184/6.18 |
| 6,247,907 | B1 * | 6/2001 | Williams | F04C 23/008 417/368 |
| 6,386,840 | B1 * | 5/2002 | Williams | F04C 23/008 417/371 |
| 6,973,804 | B2 | 12/2005 | Horiuchi et al. | |
| 7,311,501 | B2 | 12/2007 | Wehrenberg et al. | |
| 7,418,826 | B2 | 9/2008 | Rios et al. | |
| 8,105,054 | B2 * | 1/2012 | Oo | F04C 18/0215 417/410.5 |
| 2003/0002992 | A1 * | 1/2003 | Hugenroth | F04C 23/008 417/228 |

(Continued)

FOREIGN PATENT DOCUMENTS

| | | | | |
|---|---|---|---|---|
| JP | 2006266170 | A * | 10/2006 | F04C 29/026 |

OTHER PUBLICATIONS

English translation of JP-2006266170 by Espacenet Jul. 31, 2019.*

*Primary Examiner* — Deming Wan

(74) *Attorney, Agent, or Firm* — Hamre, Mueller & Larson, P.C.

(57) ABSTRACT

A heating, ventilation, air conditioning, and refrigeration (HVACR) system including a scroll compressor is disclosed. The scroll compressor includes a compression mechanism having an orbiting scroll and a non-orbiting scroll aligned in meshing engagement. The scroll compressor also includes an electric motor. A bearing housing is disposed between the compression mechanism and the electric motor. A lubricant drain is formed in the bearing housing. The lubricant drain is disposed in a location that lubricant draining from the bearing housing via the lubricant drain is directed toward the electric motor.

16 Claims, 6 Drawing Sheets

(56) References Cited

U.S. PATENT DOCUMENTS

| | | | | |
|---|---|---|---|---|
| 2004/0170509 | A1* | 9/2004 | Wehrenberg | F04C 23/008 417/371 |
| 2007/0003424 | A1 | 1/2007 | Benco et al. | |
| 2013/0092355 | A1 | 4/2013 | Douglas et al. | |
| 2016/0178255 | A1* | 6/2016 | Nishiguchi | C09K 5/045 62/115 |

* cited by examiner

OIL CIRCULATION IN A SCROLL COMPRESSOR

FIELD

This disclosure relates generally to a vapor compression system. More specifically, this disclosure relates to oil circulation rate (OCR) control in a scroll compressor for a vapor compression system such as, but not limited to, a heating, ventilation, air conditioning, and refrigeration (HVACR) system.

BACKGROUND

One type of compressor for a vapor compression system is generally referred to as a scroll compressor. Scroll compressors generally include a pair of scroll members which orbit relative to each other to compress a working fluid such as, but not limited to, air or refrigerant. A typical scroll compressor includes a first, stationary scroll member having a base and a generally spiral wrap extending from the base; and a second, orbiting scroll member having a base and a generally spiral wrap extending from the base. The spiral wraps of the stationary scroll member and the orbiting scroll member are interleaved, creating a series of compression chambers. The orbiting scroll member is driven to orbit the stationary scroll member by rotating a crankshaft. Some scroll compressors employ an eccentric pin on the rotating crankshaft that drives the orbiting scroll member.

SUMMARY

This disclosure relates generally to a vapor compression system. More specifically, this disclosure relates to oil circulation rate (OCR) control in a scroll compressor for a vapor compression system such as, but not limited to, a heating, ventilation, air conditioning, and refrigeration (HVACR) system.

A scroll compressor is disclosed. The scroll compressor includes a compression mechanism having an orbiting scroll and a non-orbiting scroll aligned in meshing engagement. The scroll compressor also includes an electric motor. A bearing housing is disposed between the compression mechanism and the electric motor. A lubricant drain is formed in the bearing housing. The lubricant drain is disposed in a location that lubricant draining from the bearing housing via the lubricant drain is directed toward the electric motor.

In an embodiment, the lubricant drain is disposed directly above the electric motor.

In an embodiment, a longitudinal axis of the lubricant drain is parallel to a longitudinal axis of a crankshaft of the scroll compressor.

In an embodiment, the lubricant drain is oriented away from a suction flow of the scroll compressor.

In an embodiment, the scroll compressor includes a plurality of lubricant drains formed in the bearing housing.

A heating, ventilation, air conditioning, and refrigeration (HVACR) system is disclosed. The HVACR system includes a compressor, a condenser, an expansion device, and an evaporator fluidly connected to form a refrigerant circuit. The compressor is a scroll compressor. The scroll compressor includes a compression mechanism having an orbiting scroll and a non-orbiting scroll aligned in meshing engagement. The scroll compressor also includes an electric motor. A bearing housing is disposed between the compression mechanism and the electric motor. A lubricant drain is formed in the bearing housing. The lubricant drain is disposed in a location that lubricant draining from the bearing housing via the lubricant drain is directed toward the electric motor.

A method of reducing an oil circulation rate in a scroll compressor is also disclosed. The method includes disposing a lubricant drain in the scroll compressor, wherein the lubricant drain is formed in a bearing housing of the scroll compressor, the lubricant drain is disposed in a location that lubricant draining from the bearing housing via the lubricant drain will be directed toward an electric motor of the scroll compressor.

BRIEF DESCRIPTION OF THE DRAWINGS

References are made to the accompanying drawings, which form a part of this disclosure, and which illustrate embodiments in which the systems and methods described in this specification can be practiced.

Like reference numbers represent like parts throughout.

DETAILED DESCRIPTION

This disclosure relates generally to a vapor compression system. More specifically, this disclosure relates to oil circulation rate (OCR) control in a scroll compressor for a vapor compression system such as, but not limited to, a heating, ventilation, air conditioning, and refrigeration (HVACR) system.

A scroll compressor can utilize a lubricant to lubricate moving parts such as, but not limited to, journal bearings, or the like. In operation, lubricant may leak from the journal bearings and be absorbed in suction fluid (e.g., a gaseous working fluid prior to compression). Absorption of the lubricant into the working fluid can lead to problems with the compression mechanism. Embodiments described in this specification are directed to a drain location for lubricant from the journal bearings that can result in a reduced oil circulation rate (OCR) (e.g., a reduced amount of lubricant absorbed into the working fluid prior to compression).

A bearing housing of the scroll compressor can include a lubricant drain. Embodiments of this disclosure include a lubricant drain in the main bearing housing that is disposed to reduce an amount of lubricant absorbed into the suction fluid. In an embodiment, locating the lubricant drain directly above an electric motor of the scroll compressor can reduce an OCR. In an embodiment, the OCR can be reduced at 60 Hz operation through 90 Hz or greater. In an embodiment, the OCR can be reduced outside of the stated range. However, the reduction of OCR can be relatively greater at increased operating speeds.

Figure 1:
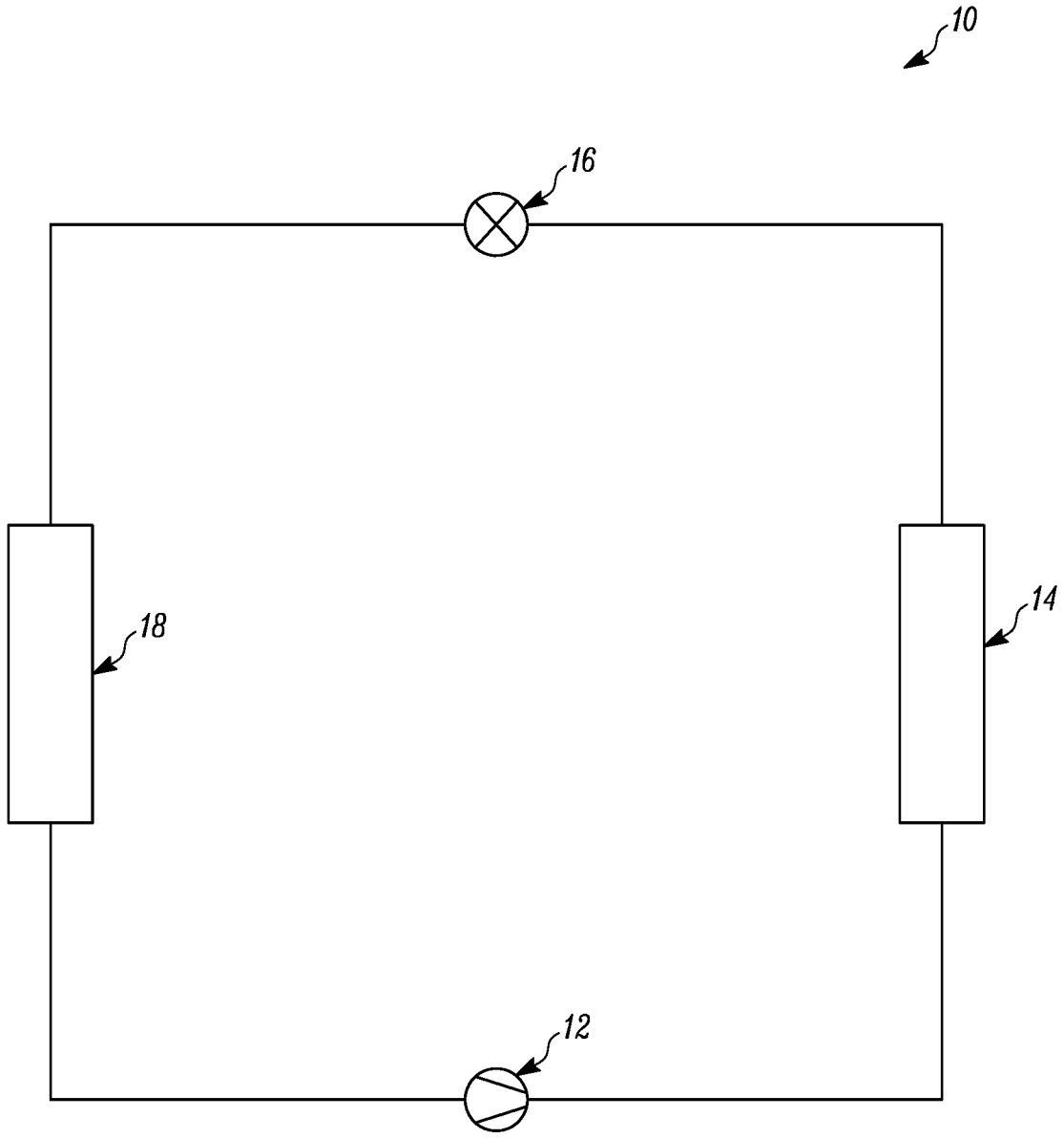
FIG. 1 is a schematic diagram of a refrigeration circuit, according to an embodiment.

FIG. 1 is a schematic diagram of a refrigerant circuit 10, according to an embodiment. The refrigerant circuit 10 generally includes a compressor 12, a condenser 14, an expansion device 16, and an evaporator 18. The compressor 12 can be, for example, a scroll compressor such as the scroll compressor shown and described in accordance with FIGS. 2-4 below. The refrigerant circuit 10 is an example and can be modified to include additional components. For example, in an embodiment, the refrigerant circuit 10 can include other components such as, but not limited to, an economizer heat exchanger, one or more flow control devices, a receiver tank, a dryer, a suction-liquid heat exchanger, or the like.

The refrigerant circuit 10 can generally be applied in a variety of systems used to control an environmental condition (e.g., temperature, humidity, air quality, or the like) in a space (generally referred to as a conditioned space). Examples of such systems include, but are not limited to, HVACR systems, transport refrigeration systems, or the like.

The compressor 12, condenser 14, expansion device 16, and evaporator 18 are fluidly connected. In an embodiment, the refrigerant circuit 10 can be configured to be a cooling system (e.g., an air conditioning system) capable of operating in a cooling mode. In an embodiment, the refrigerant circuit 10 can be configured to be a heat pump system that can operate in both a cooling mode and a heating/defrost mode.

The refrigerant circuit 10 can operate according to generally known principles. The refrigerant circuit 10 can be configured to heat or cool a liquid process fluid (e.g., a heat transfer fluid or medium such as, but not limited to, water or the like), in which case the refrigerant circuit 10 may be generally representative of a liquid chiller system. The refrigerant circuit 10 can alternatively be configured to heat or cool a gaseous process fluid (e.g., a heat transfer medium or fluid such as, but not limited to, air or the like), in which case the refrigerant circuit 10 may be generally representative of an air conditioner or heat pump.

In operation, the compressor 12 compresses a working fluid (e.g., a heat transfer fluid such as a refrigerant or the like) from a relatively lower pressure gas to a relatively higher-pressure gas. The relatively higher-pressure gas is also at a relatively higher temperature, which is discharged from the compressor 12 and flows through the condenser 14. The working fluid flows through the condenser 10 and rejects heat to a process fluid (e.g., water, air, etc.), thereby cooling the working fluid. The cooled working fluid, which is now in a liquid form, flows to the expansion device 16. The expansion device 16 reduces the pressure of the working fluid. As a result, a portion of the working fluid is converted to a gaseous form. The working fluid, which is now in a mixed liquid and gaseous form flows to the evaporator 18. The working fluid flows through the evaporator 18 and absorbs heat from a process fluid (e.g., water, air, etc.), heating the working fluid, and converting it to a gaseous form. The gaseous working fluid then returns to the compressor 12. The above-described process continues while the refrigerant circuit is operating, for example, in a cooling mode (e.g., while the compressor 12 is enabled).

Figure 2:
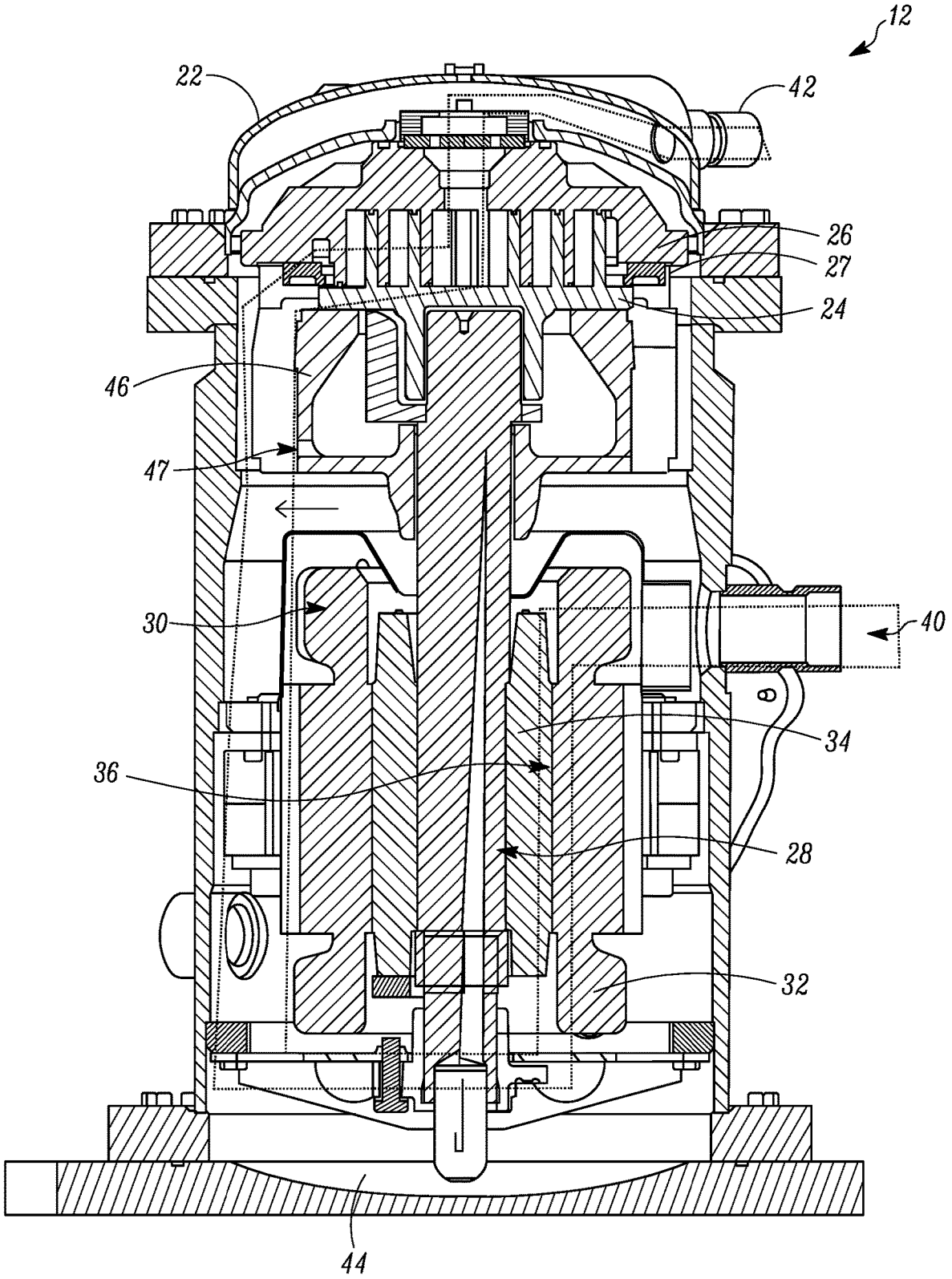
FIG. 2 PRIOR ART
FIG. 2 is a schematic diagram of a prior art compressor, according to an embodiment.

FIG. 2 is a schematic diagram of a prior art compressor 12, according to an embodiment. The compressor 12 is illustrated in sectional side view. The compressor 12 includes an enclosure 22. The compressor 12 includes a suction inlet 40 and a discharge outlet 42.

The compressor 12 includes an orbiting scroll 24 and a non-orbiting scroll 26. The non-orbiting scroll 26 is aligned in meshing engagement with the orbiting scroll 24 by means of an Oldham coupling 27. The compressor 12 includes a crankshaft 28. The crankshaft 28 can be rotatably driven by an electric motor 30. The electric motor 30 can generally include a stator 32 and a rotor 34. The crankshaft 28 is fixed to the rotor 34 such that the crankshaft 28 rotates along with the rotation of the rotor 34. The electric motor 30, stator 32, and rotor 34 can operate according to generally known principles. The compressor 12 includes a lubricant sump 44. A portion of the crankshaft 28 can, for example, fluidly communicate with the lubricant sump 44.

The compressor 12 includes a bearing housing 46. The bearing housing 46 is disposed between the electric motor 30 and the orbiting scroll 24. A lubricant drain 47 is disposed through the bearing housing 46. In particular, the lubricant drain 47 is disposed within a portion of the bearing housing 46 that faces radially outward from the crankshaft 28 and is adjacent a suction flow of the working fluid. As a result, lubricant moving through the lubricant drain 47 may be provided to the suction flow and subsequently re-entrained with the working fluid.

Figure 3:
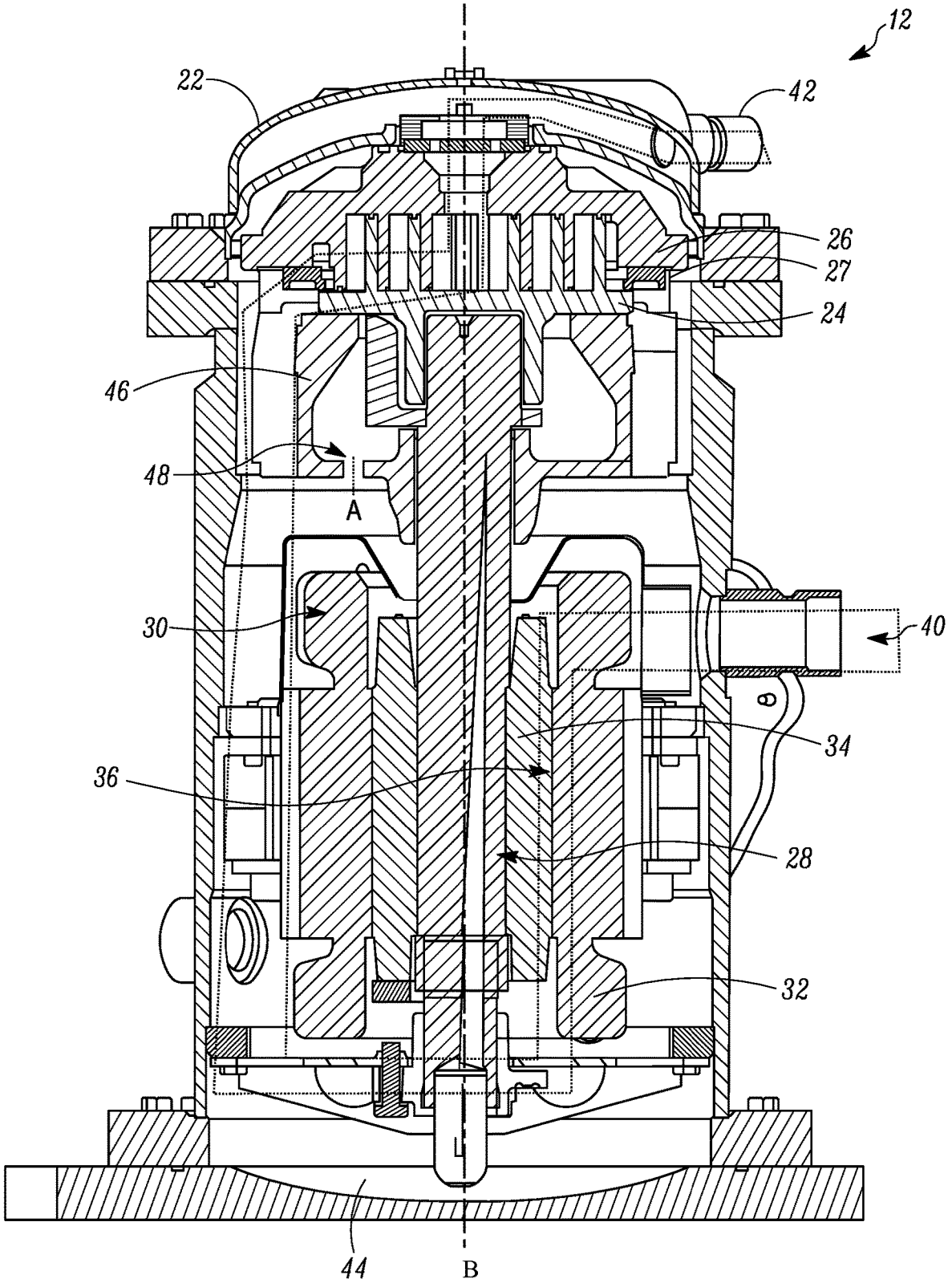
FIG. 3 is a schematic diagram of a compressor, according to an embodiment.

FIG. 3 illustrates a sectional view of the compressor 12 with which embodiments as disclosed in this specification can be practiced, according to an embodiment. The compressor 12 can be used in the refrigerant circuit 10 of FIG. 1. It is to be appreciated that the compressor 12 can also be used for purposes other than in a refrigerant circuit. For example, the compressor 12 can be used to compress air or gases other than a heat transfer fluid (e.g., natural gas, etc.). It is to be appreciated that the compressor 12 includes additional features that are not described in detail in this specification. For example, the compressor 12 can include one or more bearings.

The illustrated compressor 12 is a single-stage scroll compressor. More specifically, the illustrated compressor 12 is a single-stage vertical scroll compressor. It is to be appreciated that the principles described in this specification are not intended to be limited to single-stage scroll compressors and that they can be applied to multi-stage scroll compressors having two or more compression stages. Generally, the embodiments as disclosed in this specification are suitable for a compressor with a vertical or a near vertical crankshaft (e.g., crankshaft 28).

The compressor 12 is illustrated in sectional side view. The compressor 12 includes an enclosure 22. The enclosure 22 can include an upper portion and a lower portion. The compressor 12 includes a suction inlet 40 and a discharge outlet 42.

The compressor 12 includes an orbiting scroll 24 and a non-orbiting scroll 26. The non-orbiting scroll 26 can alternatively be referred to as, for example, the stationary scroll 26, the fixed scroll 26, or the like. The non-orbiting scroll 26 is aligned in meshing engagement with the orbiting scroll 24 by means of an Oldham coupling 27. The orbiting scroll 24 and the non-orbiting scroll 26 can collectively be referred to as a compression mechanism.

The compressor 12 includes a crankshaft 28. The crankshaft 28 can alternatively be referred to as the driveshaft 28. The crankshaft 28 can be rotatably driven by, for example, an electric motor 30. The electric motor 30 can generally include a stator 32 and a rotor 34. The crankshaft 28 is fixed to the rotor 34 such that the crankshaft 28 rotates along with the rotation of the rotor 34. The electric motor 30, stator 32, and rotor 34 can operate according to generally known principles. The crankshaft 28 can, for example, be fixed to the rotor 34 via an interference fit or the like. The crankshaft 28 can, in an embodiment, be connected to an external electric motor, an internal combustion engine (e.g., a diesel engine or a gasoline engine), or the like. It will be appreciated that in such embodiments the electric motor 30, stator 32, and rotor 34 would not be present in the compressor 12. An airgap 36 may be maintained between the stator 32 and the rotor 34. The airgap is described in additional detail with respect to FIG. 4 below.

The compressor 12 includes a lubricant sump 44. A portion of the crankshaft 28 can, for example, fluidly communicate with the lubricant sump 44.

The compressor 12 includes a bearing housing 46. The bearing housing 46 is disposed between the electric motor 30 and the orbiting scroll 24. A lubricant drain 48 is disposed through the bearing housing 46. In particular, the lubricant drain 48 is disposed within a portion of the bearing housing 46 that is disposed directly above the electric motor 30. The lubricant drain 48 is placed such that lubricant can drain toward the electric motor 30, and consequently toward the lubricant sump 44. In the illustrated embodiment, a longitudinal axis A is oriented in a vertical direction with respect to the page. As shown in the figure, the axis A is parallel to a longitudinal axis B of the crankshaft 28. As a result, lubricant moving through the lubricant drain 48 can flow vertically downward (e.g., toward the electric motor 30) with respect to the page in the figure. Compared to prior compressors, the lubricant drain 48 is placed so that the outlet of the lubricant drain 48 provides lubricant flowing therethrough in a direction that is oriented downward toward the electric motor 30 as opposed to radially outward from the crankshaft 28 of the compressor 12.

In the illustrated embodiment, a single lubricant drain 48 is shown in the bearing housing 46. It will be appreciated that a plurality of lubricant drains 48 can be included. Further, the lubricant drain 48 is shown on a left side of the crankshaft. In an embodiment, the lubricant drain 48 can be disposed a right side of the crankshaft. In an embodiment, a lubricant drain 48 can be disposed on each of the left and the right sides of the bearing housing 46. The lubricant drain 48 can also be moved relatively closer to the crankshaft 28 or relatively further from the crankshaft 28, according to an embodiment.

Figure 4:
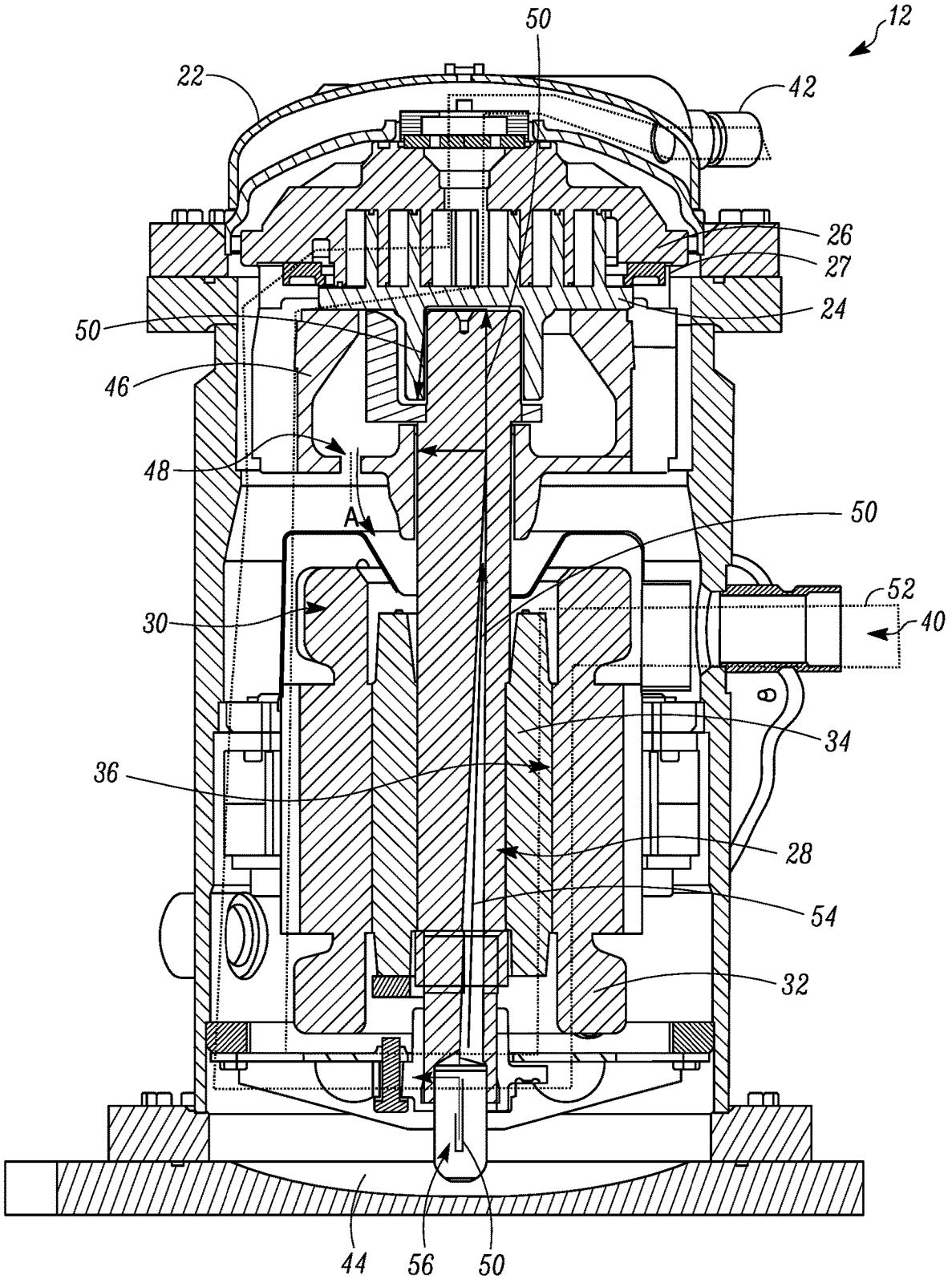
FIG. 4 is a schematic diagram of a compressor including lubricant and working fluid flow, according to an embodiment.

FIG. 4 illustrates a sectional view of the compressor 12 with which embodiments as disclosed in this specification can be practiced, according to an embodiment. FIG. 4 differs from FIG. 3 in that FIG. 4 includes arrows 50 representative of flow of lubricant when the compressor 12 is in an operating state.

In operation, a working fluid (e.g., a heat transfer fluid such as a refrigerant or the like) is received at the suction inlet 40, as illustrated by dashed lines 52. A lubricant is entrained with the working fluid at the suction inlet 40. The working fluid is directed via an airgap 36 between the rotor 28 and the stator 32. As the working fluid flows through the airgap 36, a portion of the lubricant entrained in the working fluid falls to the lubricant sump 44. The working fluid is then provided along an outer portion of the compressor 12 toward the compression mechanism (orbiting scroll 24 and non-orbiting scroll 26). The suction flow of the compressor 12 is generally vertically upward in a location of the bearing housing 46. The lubricant drain 48 is generally oriented such that an outlet of the drain faces away from the vertical suction flow. The working fluid is compressed by the compression mechanism and output via the discharge outlet 42.

The crankshaft 28 includes a lubricant channel 54 and a lubricant inlet 56. As the crankshaft 28 rotates, lubricant is provided upward via the lubricant channel 54 to the various bearings of the compressor 12. A portion of the lubricant provided to the upper bearings can drain via the lubricant drain 48 via gravity back toward the lubricant sump 44. Additionally, lubricant draining via the lubricant drain 48 may be forced downward toward the lubricant sump 44 via the working fluid flow, which is flowing downward as well.

Figure 5:
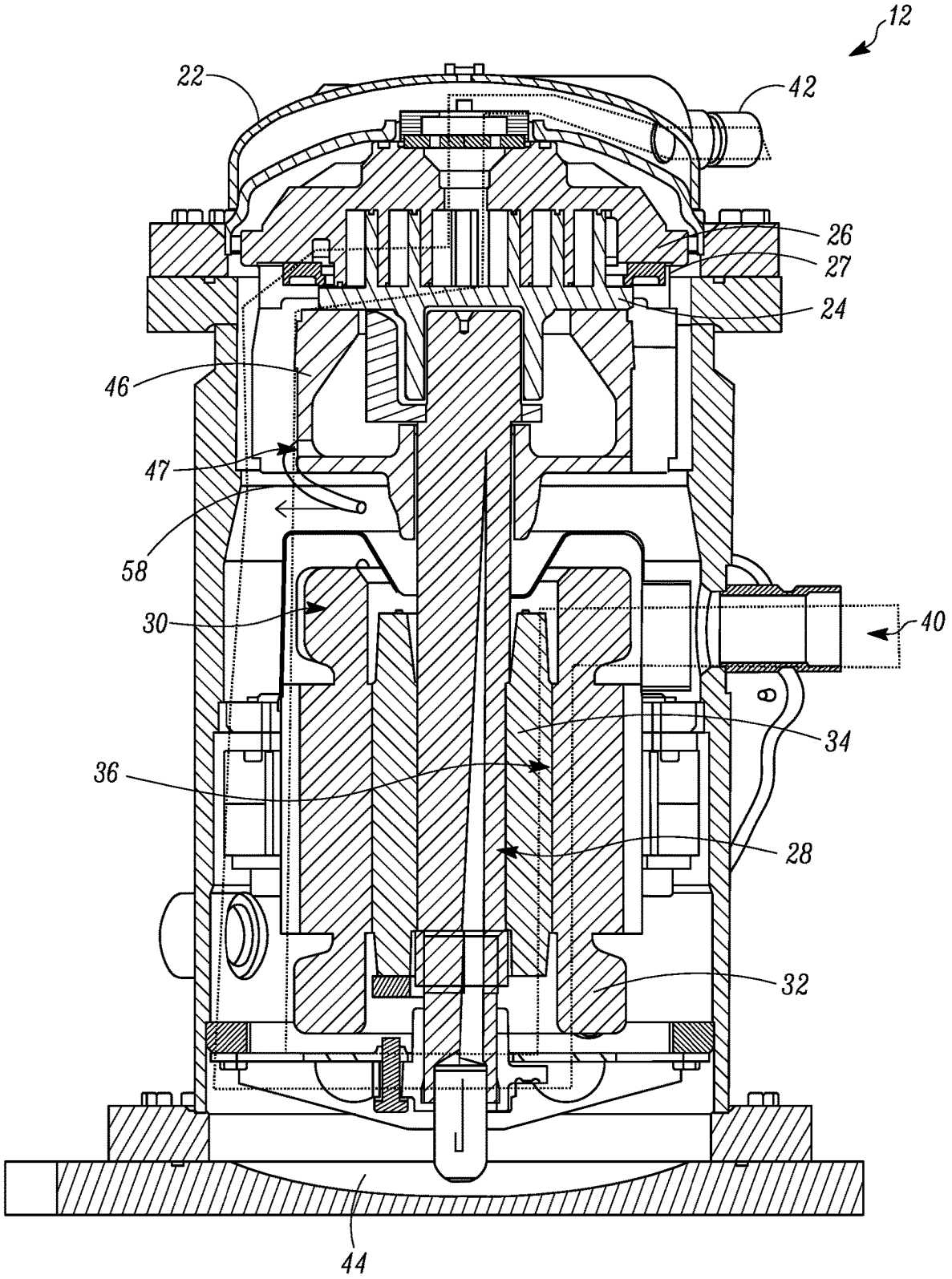
FIG. 5 is a schematic diagram of a compressor, according to another embodiment.

FIG. 5 is a sectional view of the compressor 12 with which embodiments as disclosed in this specification can be practiced, according to another embodiment. Features of FIG. 5 can be the same as or similar to features of FIG. 2. Such features will not be described again in further detail.

FIG. 5 additionally includes a lubricant conduit 58. The lubricant conduit 58 includes an inlet at lubricant drain 47. The lubricant conduit 58 provides the lubricant from the lubricant drain 47 to a location that is disposed relatively away from the suction flow of the compressor 12. As such, the compressor 12, including the lubricant conduit 58, can reduce an OCR of the compressor 12 in operation relative to the compressor of FIG. 2. The lubricant conduit 58 can be of any suitable material that is sufficiently rigid to withstand the forces from the suction flow and maintain its configuration. For example, in an embodiment, the lubricant conduit 58 can be metal.

Figure 6:
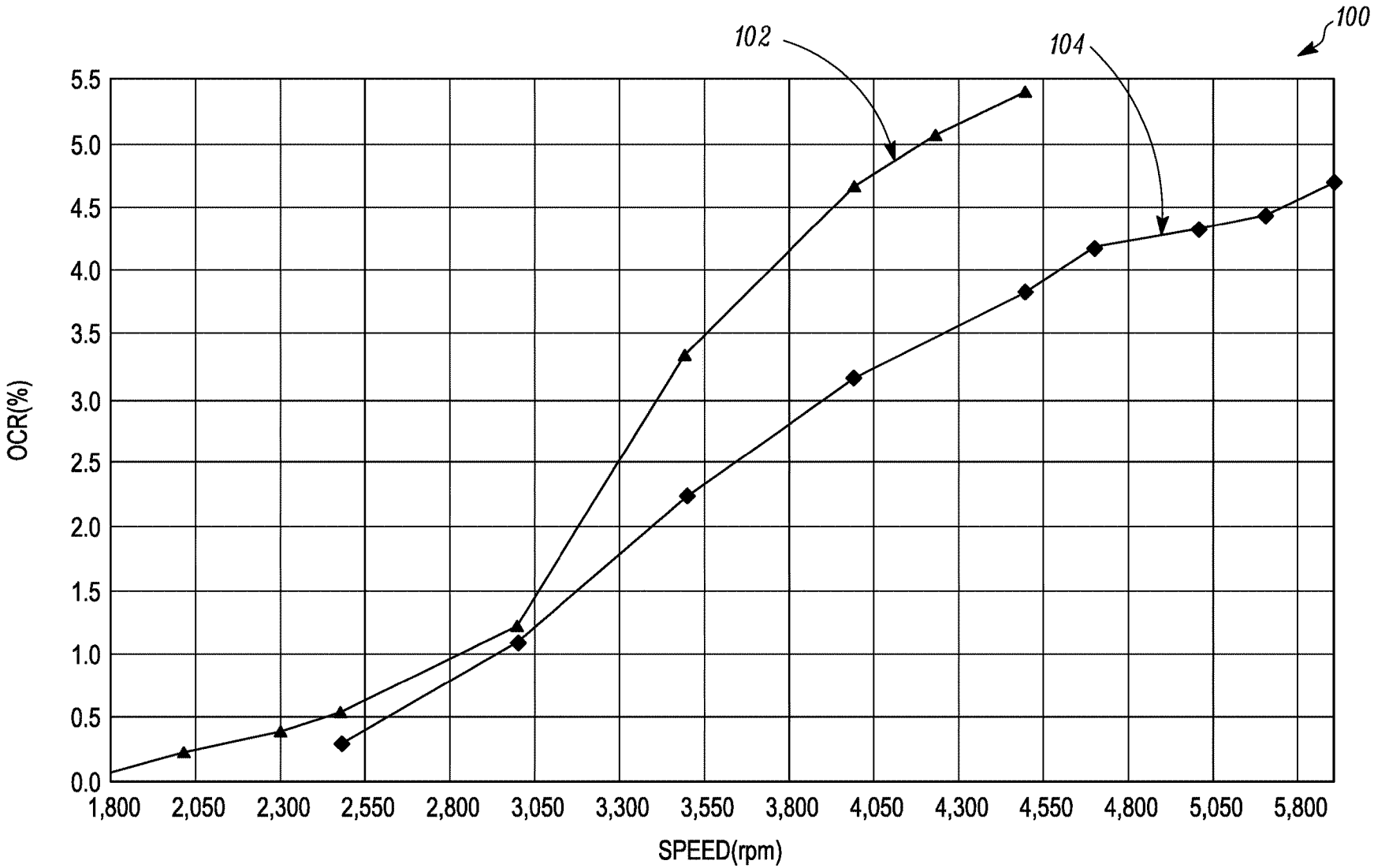
FIG. 6 is a graph including a comparison between a prior art scroll compressor and a scroll compressor including a lubricant drain in accordance with FIGS. 2 and 3, according to an embodiment.

FIG. 6 is a graph 100 including a comparison between a prior art scroll compressor and a scroll compressor including a lubricant drain in accordance with FIGS. 2 and 3 above, according to an embodiment. The illustrated graph 100 shows two lines. Line 102 is representative of a scroll compressor that does not include the lubricant drain 48. Line 104 is representative of the compressor 12 including the lubricant drain 48. The x-axis is representative of an operating speed (in revolutions per minute) of the compressors. The y-axis is representative of an oil circulation rate (OCR) in percentages. As illustrated, the scroll compressor 12 exhibits a relatively lower OCR when operated between about 2,500 RPM and about 4,500 RPM. Line 104 shows that the compressor 12 can be operated at a relatively higher speed than the compressor that does not include the lubricant drain 48, while still having a relatively lower OCR.

Aspects:

It is noted that any one of aspects 1-5 can be combined with any one of aspects 6-10 and any one of aspects 11-14. Any one of aspects 6-10 can be combined with any one of aspects 11-14.

Aspect 1. A scroll compressor, comprising:

a compression mechanism including an orbiting scroll and a non-orbiting scroll aligned in meshing engagement;

an electric motor;

a bearing housing disposed between the compression mechanism and the electric motor; and a lubricant drain formed in the bearing housing, the lubricant drain being disposed in a location that lubricant draining from the bearing housing via the lubricant drain is directed toward the electric motor.

Aspect 2. The scroll compressor according to aspect 1, wherein the lubricant drain is disposed directly above the electric motor.

Aspect 3. The scroll compressor according to any one of aspects 1 or 2, wherein a longitudinal axis of the lubricant drain is parallel to a longitudinal axis of a crankshaft of the scroll compressor.

Aspect 4. The scroll compressor according to any one of aspects 1-3, wherein the lubricant drain is oriented away from a suction flow of the scroll compressor.

Aspect 5. The scroll compressor according to any one of aspects 1-4, further comprising a plurality of lubricant drains formed in the bearing housing.

Aspect 6. A heating, ventilation, air conditioning, and refrigeration (HVACR) system, comprising:

a compressor, a condenser, an expansion device, and an evaporator fluidly connected to form a refrigerant circuit, wherein the compressor is a scroll compressor, the scroll compressor including:

a compression mechanism including an orbiting scroll and a non-orbiting scroll aligned in meshing engagement;

an electric motor;

a bearing housing disposed between the compression mechanism and the electric motor; and a lubricant drain formed in the bearing housing, the lubricant drain being disposed in a location that lubricant draining from the bearing housing via the lubricant drain is directed toward the electric motor.

Aspect 7. The HVACR system according to aspect 6, wherein the lubricant drain is disposed directly above the electric motor.

Aspect 8. The HVACR system according to any one of aspects 6 or 7, wherein a longitudinal axis of the lubricant drain is parallel to a longitudinal axis of a crankshaft of the scroll compressor.

Aspect 9. The HVACR system according to any one of aspects 6-8, wherein the lubricant drain is oriented away from a suction flow of the scroll compressor.

Aspect 10. The HVACR system according to any one of aspects 6-9, further comprising a plurality of lubricant drains formed in the bearing housing.

Aspect 11. A method of reducing an oil circulation rate in a scroll compressor, comprising:

forming a lubricant drain in the scroll compressor through a bearing housing of the scroll compressor; and orienting the lubricant drain such that lubricant draining from the bearing housing via the lubricant drain will be directed toward an electric motor of the scroll compressor.

Aspect 12. The method according to aspect 11, wherein orienting the lubricant drain includes orienting the lubricant drain such that a longitudinal axis of the lubricant drain is parallel to a longitudinal axis of a crankshaft of the scroll compressor.

Aspect 13. The method according to any one of aspects 11 or 12, wherein forming the lubricant drain in the scroll compressor includes forming the lubricant drain in a location that is disposed directly above the electric motor of the scroll compressor.

Aspect 14. The method according to any one of aspects 11-13, further comprising forming a plurality of lubricant drains in the scroll compressor.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A method of reducing an oil circulation rate in a scroll compressor, the scroll compressor including a compression mechanism, a bearing housing, and a suction inlet, the scroll compressor configured to have a suction flow path extending from the suction inlet to the compressor mechanism, and the suction flow path including a portion that extends upwards along the bearing housing, the method comprising:

forming a lubricant drain in the scroll compressor through the bearing housing of the scroll compressor;

connecting a conduit to the lubricant drain; and orienting the conduit connected with the lubricant drain such that lubricant draining from the bearing housing via the lubricant drain is directed by the conduit radially inward away from the portion of the suction flow path and toward an electric motor of the scroll compressor.

2. The method according to claim 1, wherein orienting the lubricant drain includes orienting the lubricant drain such that a longitudinal axis of the lubricant drain is perpendicular to a longitudinal axis of a crankshaft of the scroll compressor.

3. The method according to claim 1, wherein forming the lubricant drain in the scroll compressor includes forming the lubricant drain in a location that is disposed above an electric motor of the scroll compressor.

4. The method according to claim 1, further comprising forming a plurality of lubricant drains in the scroll compressor.

5. The method accord to claim 1, wherein the suction inlet is located vertically below the bearing housing and the conduit.

6. A scroll compressor, comprising:

a compression mechanism including an orbiting scroll and a non-orbiting scroll aligned in meshing engagement;

an electric motor;

a bearing housing disposed between the compression mechanism and the electric motor;

a suction inlet for the scroll compressor, the scroll compressor configured to have a suction flow path extending from the suction inlet to the compressor mechanism, the suction flow path including a portion that extends upwards along the bearing housing;

a lubricant drain formed in the bearing housing, the lubricant drain being disposed in a location that lubricant draining from the bearing housing via the lubricant drain is directed toward the electric motor, the lubricant drain including a longitudinal axis being oriented radially outward from a crankshaft; and a lubricant conduit including an inlet at the lubricant drain, the lubricant conduit configured to direct the lubricant radially inward away from the portion of the suction flow path.

7. The scroll compressor according to claim 6, wherein the lubricant drain is disposed above the electric motor.

8. The scroll compressor according to claim 6, wherein the longitudinal axis of the lubricant drain is perpendicular to the crankshaft of the scroll compressor.

9. The scroll compressor according to claim 6, further comprising a plurality of lubricant drains formed in the bearing housing.

10. The scroll compressor according to claim 6, wherein the conduit extends through the portion of the suction flow path.

11. The scroll compressor according to claim 6, wherein the suction inlet is located vertically below the bearing housing and the conduit.

12. A heating, ventilation, air conditioning, and refrigeration (HVACR) system, comprising:

a compressor, a condenser, an expansion device, and an evaporator fluidly connected to form a refrigerant circuit, wherein the compressor is a scroll compressor, the scroll compressor including:

a compression mechanism including an orbiting scroll and a non-orbiting scroll aligned in meshing engagement;

an electric motor;

a bearing housing disposed between the compression mechanism and the electric motor;

a suction inlet for the scroll compressor, the scroll compressor configured to have a suction flow path extending from the suction inlet to the compression mechanism, the suction flow path including a portion that extends upwards along the bearing housing;

a lubricant drain formed in the bearing housing, the lubricant drain being disposed in a location that lubricant draining from the bearing housing via the lubricant drain is directed toward the electric motor, the lubricant drain including a longitudinal axis being oriented radially outward from a crankshaft, and a lubricant conduit including an inlet at the lubricant drain, the lubricant conduit configured to direct the lubricant radially inwards away from the portion of the suction flow path.

13. The HVACR system according to claim 12, wherein the lubricant drain is disposed above the electric motor.

14. The HVACR system according to claim 12, wherein the longitudinal axis of the lubricant drain is perpendicular to the crankshaft of the scroll compressor.

15. The HVACR system according to claim 12, further comprising a plurality of lubricant drains formed in the bearing housing.

16. The HVACR system according to claim 12, wherein the suction inlet is located vertically below the bearing housing and the conduit.

* * * * *